United States Patent [19]

Wipff

[11] 4,214,126

[45] Jul. 22, 1980

[54] CADENCE SUPPRESSION SYSTEM

[75] Inventor: Frank P. Wipff, Garland, Tex.

[73] Assignee: RCA Corporation, New York, N.Y.

[21] Appl. No.: 591,067

[22] Filed: Apr. 30, 1945

[51] Int. Cl.[2] ..... H04K 1/02

[52] U.S. Cl. ..... 179/1.5 M; 179/1.5 R

[58] Field of Search ..... 179/1.5, 1.5 R; 250/6

[56] References Cited

U.S. PATENT DOCUMENTS

| | | | |
|---|---|---|---|
| 2,413,396 | 12/1946 | Weagant | 179/1.5 R |
| 2,530,140 | 11/1950 | Atkins | 179/1.5 R |
| 2,530,142 | 11/1950 | Atkins | 179/1.5 R |
| 3,967,067 | 6/1976 | Potter | 179/1.5 R |
| 3,976,839 | 8/1976 | Miller | 179/1.5 R |

*Primary Examiner*—Howard A. Birmiel

*Attorney, Agent, or Firm*—Samuel Cohen; Robert L. Troike

EXEMPLARY CLAIM

1. A secret telecommunication system including a source of communication signals, a signal cadence suppression circuit including means responsive to the envelope of said communication signals for generating a spurious signal, means for combining said communication signals and said spurious signal, means for coding said combined signals, means for transmitting said coded combined signals, means for receiving and decoding said transmitted signals, spurious signal rejection means responsive to said received decoded signals for separating said spurious signal component from said communication signal component of said received decoded signals, and means for utilizing said separated communication signal component.

25 Claims, 4 Drawing Figures

CADENCE SUPPRESSION SYSTEM

Figure 1:
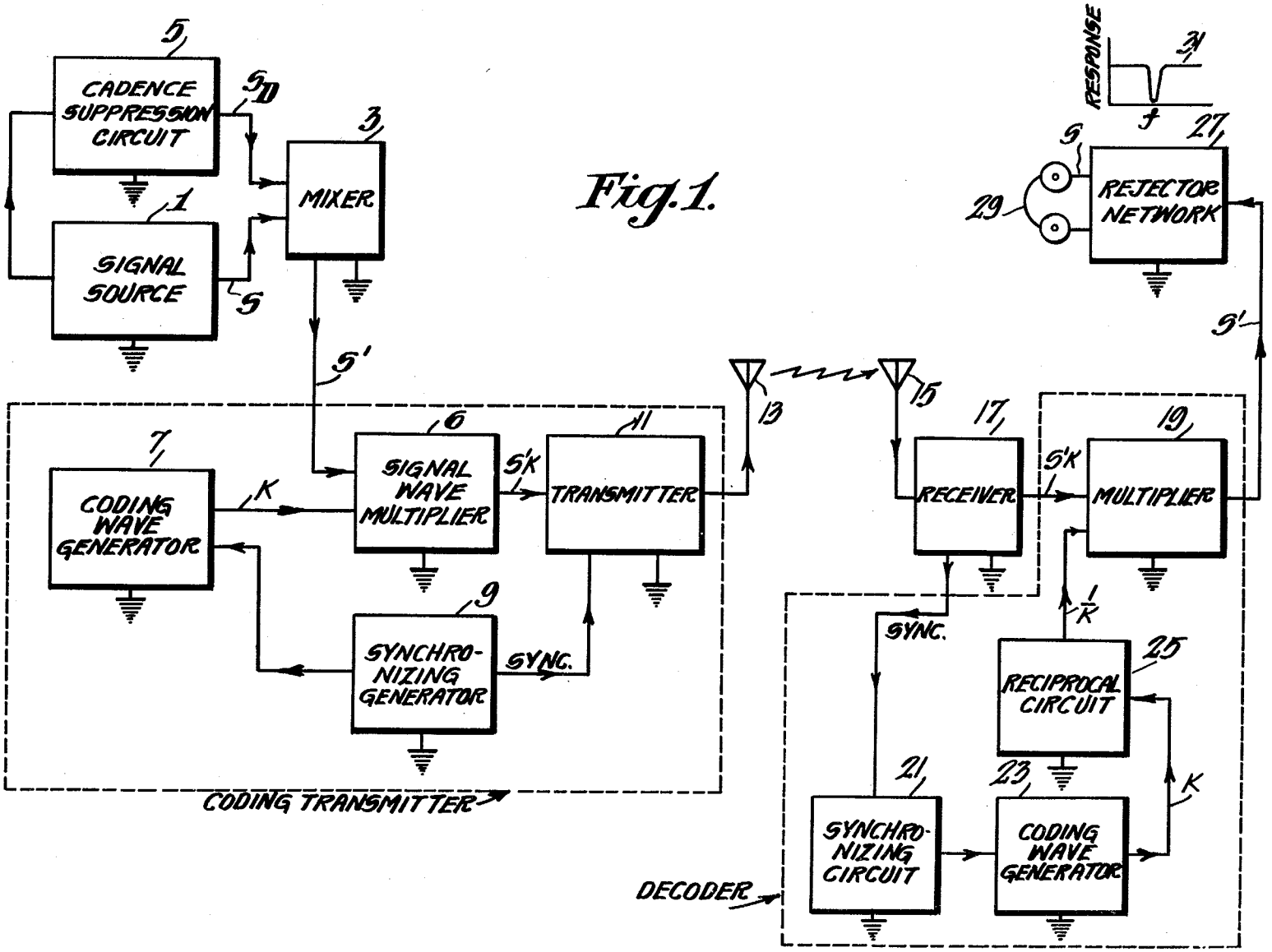

The present invention relates to wave transmission systems and more particularly to an improved method of and means for improving the security of a secret telecommunication system by destroying the cadence of the communication signal.

The invention, by way of example, will be described hereinafter as an improvement in a secret telecommunication system of the general type described in the copending U.S. application of Alda V. Bedford, Ser. No. 536,630, filed May 20, 1944. Said copending application discloses a system wherein, for example, a speech signal comprising a complex wave S is modified by means of a coding signal comprising a complex wave K, in a manner whereby the instantaneous ordinates of the resulting coded signals are the product SK of the corresponding instantaneous ordinates of the speech signal and the coding signal. The resulting unintelligible coded signals are transmitted by any conventional means to a receiver wherein the coded signals are combined with decoding signals generated in the receiver and having instantaneous ordinates corresponding to the reciprocal of the corresponding instantaneous ordinates of the coding signal component of the transmitted signal. The final signals, therefore, are derived from the product of the transmitted signal SK and the decoding signal 1/k. The coding and decoding signal generators at the transmitter and receiver, respectively, are synchronized by a unique system wherein synchronizing pulse signals, each comprising a first signal pulse immediately followed by a second signal pulse of opposite polarity, are superimposed upon the coded signals SK at predetermined intervals. At the receiver, the reversal in polarity between the two synchronizing pulses is employed to synchronize the decoding wave generator.

Due to the inherent cadence of speech, the signals may be partially intelligible even though the received signals are improperly decoded. The instant invention increases the security of such secret telecommunication by destroying the speed cadence before it is coded by the complex coding wave K at the transmitter. In order to destroy the speech cadence, a sine wave, broken at a syllabic rate, is added to the speech wave before it is combined with the coding wave K. The syllabically-interrupted sine wave is derived by detecting the speech envelope, delaying it by means of appropriate delay networks, and by employing the delayed speech envelope to key on and off, or to modulate the output of, a sinewave oscillator. The oscillator may be both keyed and modulated, and it may be either amplitude modulated or frequency modulated, or both, by the delayed speech envelope. The frequency of the oscillator may be either within the speech frequency band, or just outside of the speech band.

When the oscillator frequency is within the speech band, the tone may be removed from the output of the received signals by means of a sharply selective rejector circuit. When the oscillator frequency is outside of the speech band, it may be separated from the received signals by any conventional type of rejector or band-pass filter network. It should be understood that if frequency modulation of the oscillator is employed in response to the delayed speech envelope, the cadence destroying tone must be outside of the speech band, in order that it may be filtered therefrom at the receiver. In a secret telecommunication system of the type generally described heretofore, the cadence-destroying tone, which is modulated or keyed by the delayed speech envelope, is mixed with the speech signals S and then is coded by multiplication of the mixed wave ordinates with the ordinates of the coding signal K. Since the cadence-destroying tone comprises spurious "syllables" interposed between the true syllables of the speech signal, the coded speech is rendered much less intelligible than is the case with known prior systems. Since both the speech signal and the cadence-destroying tone are coded by means of the coding wave K, it is necessary to decode the received signal before the cadence-destroying tone may be separated from the speech signal S, because of the spreading of the tone frequency and its harmonics throughout the spectrum of the coded signals.

Among the objects of the invention are to provide an improved method of and means for secret telecommunication. Another object of the invention is to provide an improved method of and means for destroying cadence in a secret telecommunication system. A further object of the invention is to provide an improved method of and means for destroying the cadence of a speech signal, and then combining the modified speech signal with a coding signal for transmission to a remote decoding receiver. An additional object of the invention is to provide an improved method of and means for destroying the cadence of a speech signal by generating a cadence-destroying signal which is modified by means of delayed signals responsive to the speech signal envelope, and thence combining the modified cadence-destroying signal with the speech signal. Another object of the invention is to provide an improved method of and means for transmitting coded communication signals wherein the cadence of the communication signal is destroyed. A further object of the invention is to provide an improved method of and means for receiving, decoding, and restoring the cadence of a secret telecommunication signal wherein the cadence is removed prior to transmission. An additional object of the invention is to provide a signal cadence suppression circuit for communication signals wherein a spurious signal having syllabic characteristics related to and delayed with respect to said communication signals is combined with said signals to destroy the syllabic characteristics thereof.

Figure 2:
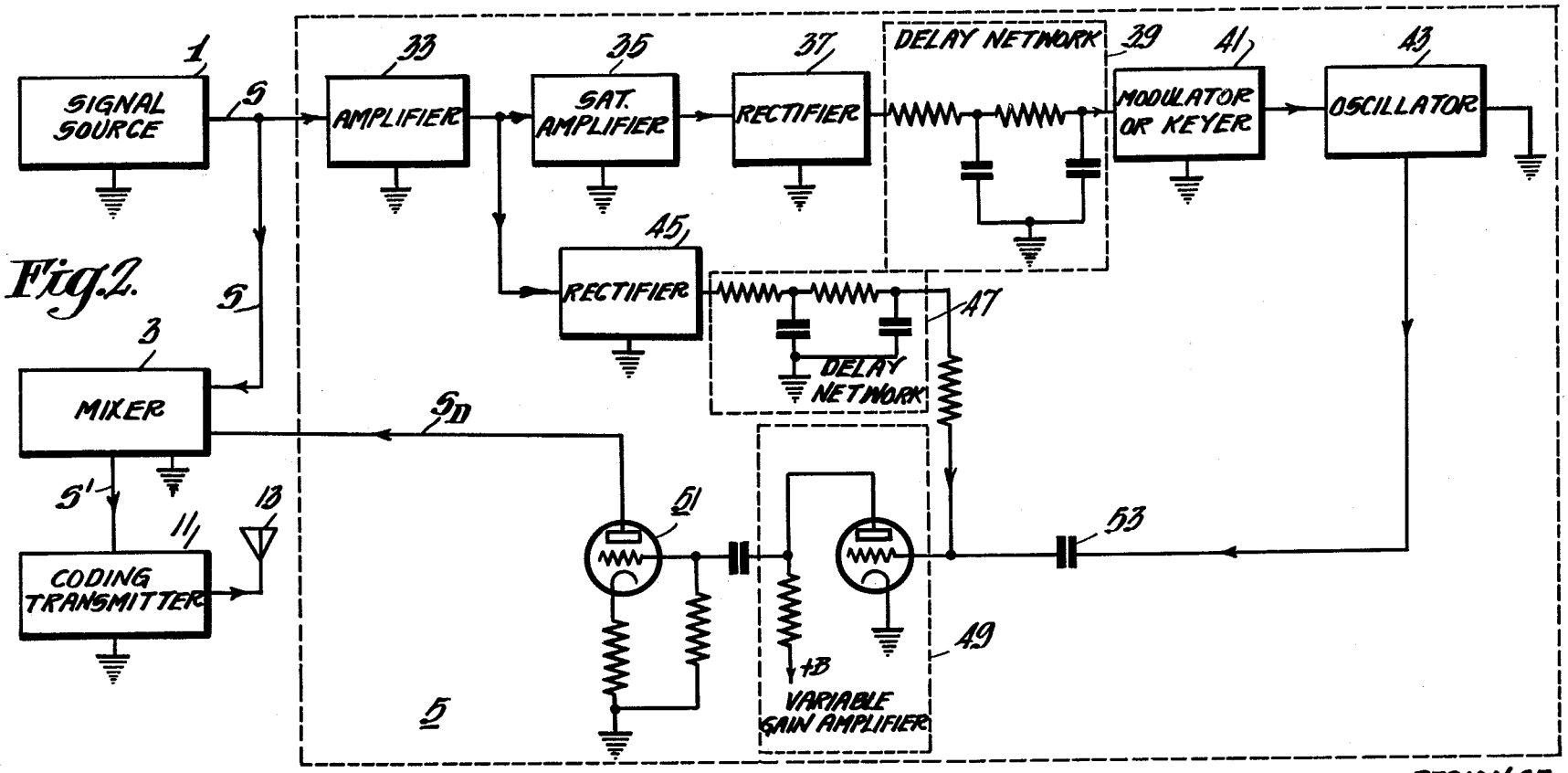
Figure 4:
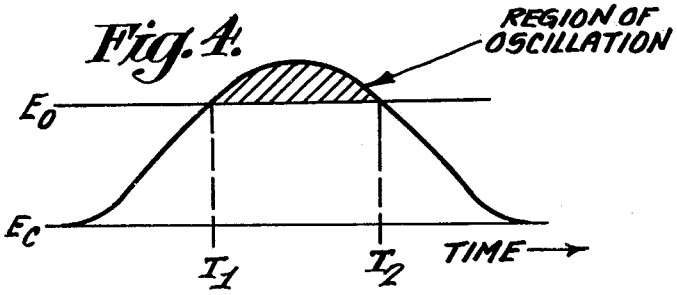
Figure 3:
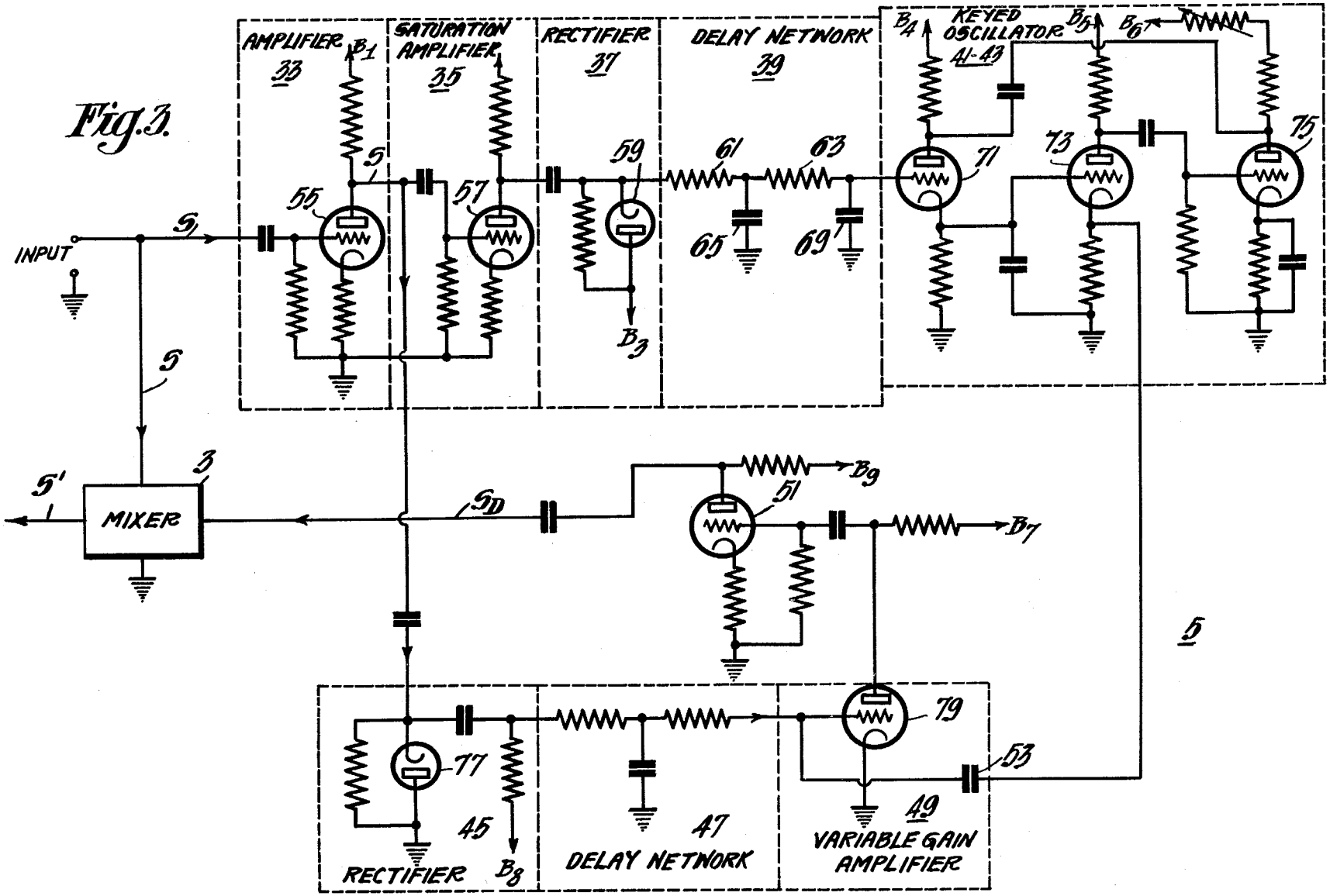

The invention will be described in greater detail by reference to the accompanying drawings of which FIG. 1 is a block schematic circuit diagram of a complete secret telecommunication system employing the invention, FIG. 2 is a partially schematic, block circuit diagram of a coding signal transmitter including the invention, FIG. 3 is a schematic circuit diagram of the signal cadence suppression circuit forming a portion of said coding signal transmitter, and FIG. 4 is a graph illustrating the characteristics of the keyed signal cadence suppression oscillator.

Similar reference characters are applied to similar elements throughout the drawings.

COMPLETE SYSTEM

Transmitter

Referring to FIG. 1, a complete secret telecommunication system employing the invention may comprise a signal source 1, such as, for example, a microphone and a conventional input amplifier, connected to one input circuit of a signal mixer 3. The output of the signal source 1 also is connected to the input circuit of a cadence suppression circuit 5, described in detail hereinafter, which generates a cadence suppressing signal $S_D$ which is a function of, and which is delayed with respect to, the speech signals derived from the signal source 1. The cadence suppression signals $S_D$ also are applied to another input circuit of the signal mixer 3. The signal mixer 3 may comprise, for example, a pair of amplifiers having separate input circuits energized by the speech signals and the cadence suppression signals, respectively, and a common output circuit.

The additively combined signals S' from the signal mixer comprise the speech signal with interfering signals from the cadence suppression circuit interposed between successive peaks in the envelope of the speech signals. The combined signals S' thence are applied to one input circuit of a signal wave multiplier circuit 6, wherein they are coded by a complex coding wave K derived from a coding wave generator 7. The signal wave multiplier 5 combines the modified speech signals S' and the coding wave K to provide a coded wave S'K having ordinates which are the product of the corresponding ordinates of the modified speech wave S' and the coding wave K. The coding wave generator 7 is synchronized by signals from a synchronizing generator 9, which also supplies synchronizing signals to a radio transmitter 11, wherein they are superimposed upon the coded signal S'K. The transmitter 11 is connected to a conventional antenna 13, and may include phase and frequency response correction networks for optimum fidelity.

Receiver

Signals received by a receiving antenna 15 at a remote point are applied to a radio receiver 17, which applies the signals S'K to one input circuit of a receiver signal wave multiplier 19. The synchronizing signals derived from the receiver 17 are selected by a sychronizing circuit 21 which keys a second coding wave generator 23 to generate a similar complex coding wave K at the receiver. The complex coding wave K is applied to the input of a reciprocal wave circuit 25 which generates a wave 1/K having ordinates which approximate the reciprocal of the corresponding ordinates of the receiver coding wave K. It should be understood that the reciprocal of zero signal ordinates may not be infinite since the signal circuits have finite power limitations. The reciprocal wave 1/K is applied to a second input circuit of the receiver signal wave multiplier 19 from which is derived the product S' of the waves S'K and 1/K. The product wave S' derived from the receiver multiplier circuit is applied to a conventional frequency-selective rejector network 27 which separates the signal suppression tone $S_D$ from the original speech signal S. The speech signal S is applied to headphones 29 or to any other utilization device. The graph 31 illustrates the frequency selective characteristics of the rejector network 27 which removes the cadence suppression signal $S_D$ from the decoded received signal.

It should be understood that the particular coding transmitter 12 and receiver decoder illustrated and explained herein are employed purely by way of illustration, and that any other known type of secret signal coding and decoding system may be employed for transmission of the modified speech signal S'.

The circuit of FIG. 2 shows in greater detail the various components of the cadence suppression circuit 5. In order to provide the cadence suppression signal $S_D$, signals from the speech signal source 1 are applied through an amplifier 33 to a saturation amplifier 35 which clips the higher speech signal peaks and provides an output signal characteristic of the syllabic variations of the speech signal S. In effect, the syllabic variations are isolated from other amplitude variations, whereby both low and high amplitude syllables similarly affect the output signal. Output signals from the saturation amplifier 35 are rectified by a rectifier 37, delayed by a first delay network 39 and applied to a modulator or keyer circuit 41 which is responsive to the smoothed low-frequency pulses derived from the delay network 39. The modulator or keyer 41 controls the output of an oscillator 43 which generates an interfering tone pulse in response to each keying pulse derived from the delay network 39. The frequency of the oscillator 43 may be either within or just without the frequency band of the speech signals derived from the signal source 1. The interfering pulses derived from the oscillator 43 are delayed with respect to successive peaks in the envelope of the speech signal.

The output of the amplifier 33 also is applied to a second rectifier 45, the rectified output of which is applied through a second delay network 47 to control the gain of a variable gain amplifier 49, to the input circuit of which is applied the interfering pulses from the oscillator 43. Thus, the envelope of the speech wave S controls the amplitude of the interfering signal tone pulses derived from the oscillator 43, whereby the envelope of the interfering tone is a function of the envelope of the speech signal S and the successive peaks thereof are delayed with respect to corresponding signal peaks of the speech signal S. The thus modified signal tone is passed through an output amplifier 51 to apply the cadence suppression signal $S_D$ to the signal mixer 3.

The purpose of the saturation amplifier 35 is to produce keying pulses which are more or less independent in amplitude of the speech level, thus keying the oscillator on and off independently of the speech amplitude. In order that the ratio between the amplitudes of the speech signal and the interfering tone derived from the oscillator 43 may remain substantially constant, the output of the unsaturated amplifier 33 is employed to control both the timing and the average level of the interfering signal. The signals from the oscillator 43 are applied to the variable gain amplifier through a small capacitor 53 to eliminate objectionable low-frequency components in the keyed oscillator output signal.

FIG. 3 is a schematic circuit diagram of the cadence suppression circuit 5 wherein the unsaturated amplifier 33 includes a triode 55, the saturated amplifier comprises a second triode 57 biased to a predetermined limiting point on its static characteristic, the rectifier 37 comprises a shunt-connected diode 59 connected to a source of bias potential $B_3$, and the first delay network 39 comprises serially-connected resistors 61, 63 and shunt-connected capacitors 65, 69, in which the parameters are selected to provide the required delay. The keyed oscillator 41–43 is of the R-C advance-retard type employing three cascaded triodes 71, 73, 75, of which the first oscillator triode 71 is keyed by the low-frequency pulses derived from the delay network 39. As shown in the graph of FIG. 4, the oscillator grid circuits are biased to a voltage $E_C$ which effectively prevents oscillation. When the applied low-frequency keying pulses derived from the delay network 39 cause the oscillator bias to exceed the value $E_O$, the oscillator commences to oscillate and the output voltage passes through a peak value until the grid voltage again reaches the value $E_O$, at which time the oscillator ceases to oscillate. Thus, between the times $T_1$ and $T_2$, a single oscillator pulse is generated which is delayed with respect to a particular speech signal pulse. In this manner, a single pulse of the oscillator frequency is generated following each speech syllable of sufficient amplitude and duration to provide an oscillator grid bias above the value $E_O$.

As explained heretofore, signals from the unsaturated amplifier 33 also are applied to the second rectifier 45 which comprises a second diode 77. Signals from the second rectifier 45 are delayed in a second delay network 47, the parameters of which are similar to those of the first delay network 39, to provide a gain control voltage for the grid of the variable gain amplifier 49 which comprises a variable gain triode 79. Signals from the cathode of the second oscillator tube 73 are applied, through the small coupling capacitor 53, to the grid of the variable gain amplifier tube 79. Thus, as explained heretofore, the output signals $S_D$ derived from the output amplifier tube 51 are delayed with respect to, and have amplitudes which are closely related to, corresponding signal peaks of the speech signal S.

It should be understood that instead of employing the pulses derived from the first delay network 39 to key an oscillator of the type described, any other type of oscillator may be employed which is capable of generating interfering signals within or adjacent to the speech signal range. The delayed control signals derived from said delay network may be employed to modulate either the amplitude or the frequency of such an oscillator. Also, if desired, the variable gain amplifier and its associated gain control circuits may be omitted and the keyed or modulated signal derived from the oscillator may be employed directly for distorting the speech signal S. As has been explained heretofore, if the oscillator is frequency modulated, it will be essential that its frequency range be outside of the frequency range of the speech signal in order that the interfering signals may be separated from the speech signals after the transmitted signals have been decoded at the receiver.

Thus, the invention disclosed comprises an improved method of and means for suppressing the cadence of speech signals in a secret telecommunication system by generating an interfering signal which is a function of and which is delayed with respect to the speech signal. The speech signal and interfering signals are combined and coded in any desired manner for transmission. A novel cadence suppression circuit for generating the interfering signals is disclosed and several modifications thereof are suggested.

I claim as my invention:

1. A secret telecommunication system including a source of communication signals, a signal cadence suppression circuit including means responsive to the envelope of said communication signals for generating a spurious signal, means for combining said communication signals and said spurious signal, means for coding said combined signals, means for transmitting said coded combined signals, means for receiving and decoding said transmitted signals, spurious signal rejection means responsive to said received decoded signals for separating said spurious signal component from said communication signal component of said received decoded signals, and means for utilizing said separated communication signal component.

2. A secret telecommunication system including a source of communication signals, a signal cadence suppression circuit including means responsive to the envelope of said communication signals for generating a spurious signal which is delayed with respect to and which varies in magnitude as a function of variations in said envelope, means for combining said communication signals and said spurious signal, means for coding said combined signals, means for transmitting said coded combined signals, means for receiving and decoding said transmitted signals, spurious signal rejection means responsive to said received decoded signals for separating said spurious signal component from said communication signal component of said received decoded signals, and means for utilizing said separated communication signal component.

3. A secret telecommunication system including a source of communication signals, a signal cadence suppression circuit including means responsive to the envelope of said communication signals for generating a spurious signal which is delayed with respect to and which varies in frequency as a function of variations in said envelope, means for combining said communication signals and said spurious signal, means for coding said combined signals, means for transmitting said coded combined signals, means for receiving and decoding said transmitted signals, spurious signal rejection means responsive to said received decoded signals for separating said spurious signal component from said communication signal component of said received decoded signals, and means for utilizing said separated communication signal component.

4. A secret telecommunication system including a source of communication signals, a signal cadence suppression circuit including means responsive to the envelope of said communication signals for generating a spurious signal having a frequency within the communication signal band and which is delayed with respect to and varies as a function of said envelope, means for combining said communication signals and said spurious signal, means for coding said combined signals, means for transmitting said coded combined signals, means for receiving and decoding said transmitted signals, spurious signal rejection means responsive to said received decoded signals for separating said spurious signal component from said communication signal component of said received decoded signals, and means for utilizing said separated communication signal component.

5. A transmitter for secret telecommunication including a source of communication signals, a signal cadence suppression circuit including means responsive to the envelope of said communication signals for generating a spurious signal, means for combining said communication signals and said spurious signal, means for coding said combined signals, and means for transmitting said coded combined signals.

6. A transmitter for secret telecommunication including a source of communication signals, a signal cadence suppression circuit including means for generating a spurious signal, modulating means responsive to the envelope of said communication signals for varying said spurious signal as a function of said communication signal envelope and delayed with respect to said envelope, means for combining said communication signals and said modulated and delayed spurious signal, means for coding said combined signals, and means for transmitting said coded combined signals.

7. A transmitter for secret telecommunication including a source of communication signals, a signal cadence suppression circuit including signal saturable means responsive to the envelope of said communication signals for deriving a limited signal, means for rectifying said limited signal, means for delaying said rectified signal, means for generating a spurious signal, means for modulating said spurious signal by said delayed rectified signal, means for combining said communication signals and said modulated spurious signal, means for coding said combined signals, and means for transmitting said coded combined signals.

8. Apparatus as claimed in claim 7 including means for controlling the envelope of said modulated spurious signal as a function of the envelope of said communication signal.

9. A transmitter for secret telecommunication including a source of communication signals, a signal cadence suppression circuit including means responsive to the envelope of said communication signals for generating a spurious signal, means for combining said communication signals and said spurious signal, means for generating a complex coding signal, means for combining said combined signals and said coding signal in a manner whereby the instantaneous ordinates of the resultant signal are the product of the instantaneous ordinates of the combined and coding signal waves, and means for transmitting said resultant product signal.

10. A transmitter for secret telecommunication including a source of communication signals, a signal cadence suppression circuit including signal limiting means responsive to the envelope of said communication signals for deriving a limited signal, means for rectifying said limited signal, means for delaying said rectified signal, means for generating a spurious signal, means for modulating said spurious signal by said delayed rectified signal, means for rectifying and delaying said communication signals, means for controlling the envelope of said modulated spurious signal in response to said rectified delayed communication signal, means for combining said communication signals and said controlled spurious signal, means for generating a complex coding signal, means for combining said combined signals and said coding signal in a manner whereby the instantaneous ordinates of the resultant signal are the product of the instantaneous ordinates of the combined and coding signal waves, and means for transmitting said resultant product signal.

11. A signal cadence suppression circuit including connection means for a source of communication signals, means connected to said connection means for delaying the envelope of said signals, means responsive to said delayed envelope of said communication signals for generating a spurious signal having a different envelope than said communication signals, and means for combining said communication signals and said spurious signal to provide a distorted communication signal in which the original signal cadence is substantially suppressed.

12. A signal cadence suppression circuit including connection means for a source of communication signals, signal limiting means connected to said connection means responsive to the envelope of said communication signals for deriving a limited signal, means for rectifying said limited signal, means for delaying said rectified signal, means for generating a spurious signal, means for modulating said spurious signal by said delayed signal, and means for combining said communication signals and said modulated spurious signal to provide a distorted communication signal in which the original signal cadence is substantially suppressed.

13. Apparatus as claimed in claim 12 including means for rectifying said communication signals, means for delaying said rectified communication signals, and means for controlling the envelope of said modulated spurious signal in response to said rectified delayed communication signals.

14. A signal cadence suppression circuit including connection means for a source of communication signals, means connected to said connection means responsive to the envelope of said communication signals for limiting said communication signals, means for rectifying said limited signals, means for delaying said rectified signals, means for generating interfering pulse signals, means for applying said delayed rectified signals to key said pulse signals, means responsive to said communication signals for controlling the envelope of said keyed pulse signals, and means for combining said communication signals and said controlled pulse signals to provide a distorted communication signal in which the original signal cadence is substantially suppressed.

15. A signal cadence suppression circuit including connection means for a source of communication signals, means connected to said connection means responsive to the envelope of said communication signals for limiting said communication signals, means for rectifying said limited signals, means for delaying said rectified signals, means for generating interfering pulse signals, means for applying said delayed rectified signals to modulate said pulse signals, means responsive to said communication signals for controlling the envelope of said modulated pulse signals.

16. A signal cadence suppression circuit including connection means for a source of communication signals, means connected to said connection means responsive to the envelope of said communication signals for limiting said communication signals, means for rectifying said limited signals, means for delaying said rectified signals, means for generating interfering pulse signals, means for applying said delayed rectified signals to frequency modulate said pulse signals, means responsive to said communication signals for controlling the envelope of said modulated pulse signals.

17. A receiver for secret telecommunication signals of the type having instantaneous ordinates which are the product of the instantaneous ordinates of a communication signal having a spurious signal component and of a coding signal, including a receiver for said product signals, means for generating a decoding wave having ordinates which are the reciprocal of the coding wave component of said received signals, means for combining said received signals and said reciprocal coding signals to derive said communication signal having said spurious signal component, spurious signal rejection means responsive to said received decoded communication signals for separating said spurious signal component from said communication signal component of said received decoded signals, and means for utilizing said separated communication signal component.

18. A receiver for secret telecommunication signals of the type having instantaneous ordinates which are the product of the instantaneous ordinates of a communication signal having a modulated spurious signal component and of a coding signal including a receiver for said product signals, means for generating a decoding wave having ordinates which are the reciprocal of the coding wave component of said received signals, means for combining said received signals and said reciprocal coding signals to derive said communication signal having said modulated spurious signal component, spurious signal rejection means responsive to said received decoded communication signals for separating said spurious signal component from said communication signal component of said received decoded signals, and means for utilizing said separated communication signal component.

19. A receiver for secret telecommunication signals of the type having instantaneous ordinates which are the product of the instantaneous ordinates of a communication signal having a frequency-modulated spurious signal component and of a coding signal including a receiver for said product signals, means for generating a decoding wave having ordinates which are the reciprocal of the coding wave component of said received signals, means for combining said received signals and said reciprocal coding signals to derive said communication signal having said frequency-modulated spurious signal component, spurious signal rejection means responsive to said received decoded communication signals for separating said spurious signal component from said communication signal component of said received decoded signals, and means for utilizing said separated communication signal component.

20. The method of secret telecommunication for signal intelligence comprising the steps of delaying said intelligence signals, generating a spurious signal in response to the envelope of said delayed intelligence signals, combining said spurious signals and said intelligence signals, coding said combined signals, transmitting said coded combined signals, receiving and decoding said transmitted signals, separating said spurious signal from said received decoded signals and utilizing said separated intelligence signal.

21. The method of transmitting signal intelligence comprising the steps of deriving communication signals, generating a spurious signal delayed with respect to and modulated as a function of the envelope of said communication signals, combining said communication signals and said delayed and modulated spurious signal to suppress communication signal cadence, coding said combined signals and transmitting said coded combined signals.

22. The method of secret telecommunication for a source of communication signals comprising the steps of generating spurious signals delayed with respect to and modulated as a function of said communication signals, combining said communication signals and said delayed modulated spurious signals to suppress communication signal cadence, generating a complex coding signal, combining said combined signals and said coding signal in a manner whereby the instantaneous ordinates of the resultant signal are the product of the instantaneous ordinates of the combined and coding signal waves and transmitting said resultant product signal.

23. The method of suppressing cadence in a communication signal comprising the steps of delaying the envelope of said signal, generating a spurious signal having characteristics which are a function of the delayed envelope of said communication signals, and combining said communication signals and said spurious signal to provide a distorted communication signal in which the original signal cadence is substantially suppressed.

24. The method of suppressing cadence in a communication signal comprising the steps of limiting said signals, rectifying said limited signals, delaying said rectified signals, generating a spurious signal, modulating said spurious signal in response to said delayed rectified signals, rectifying said communication signals, delaying said rectified communication signals, controlling said modulated spurious signal in response to said delayed rectified communication signals, and combining said communication signals and said controlled modulated spurious signal to provide a distorted communication signal in which the original signal cadence is substantially suppressed.

25. The method of receiving secret telecommunication signal waves of the type having instantaneous ordinates which are the product of the instantaneous ordinates of a communication signal wave having a spurious signal component and of a coding signal wave comprising the steps of receiving said product signals, generating a decoding wave having ordinates which are the reciprocal of the coding wave component of said received signals, combining said received signals and said reciprocal coding signals to derive said communication signal including said spurious signal component, separating said spurious signal component from said communication signal, and utilizing said separated communication signal component.

* * * * *

UNITED STATES PATENT AND TRADEMARK OFFICE
CERTIFICATE OF CORRECTION

PATENT NO. : 4,214,126

DATED : July 22, 1980

INVENTOR(S) : Frank P. Wipff

It is certified that error appears in the above-identified patent and that said Letters Patent is hereby corrected as shown below:

Column 1, line 42, "speed" should be --speech--;

Signed and Sealed this

*Sixth* Day of *January 1981*

[SEAL]

*Attest:*

SIDNEY A. DIAMOND

*Attesting Officer*

*Commissioner of Patents and Trademarks*